US009331428B2

(12) United States Patent
Kawamura et al.

(10) Patent No.: US 9,331,428 B2
(45) Date of Patent: May 3, 2016

(54) CONNECTOR MATEABLE WITH MATING CONNECTOR AND HAVING LOCK STRUCTURE INCLUDING LOCK MEMBER AND OPERATION MEMBER WHICH IS OPERABLE TO MOVE LOCK MEMBER

(71) Applicant: JAPAN AVIATION ELECTRONICS INDUSTRY, LIMITED, Shibuya-ku, Tokyo (JP)

(72) Inventors: Chikara Kawamura, Tokyo (JP); Yukitaka Tanaka, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 14/607,860

(22) Filed: Jan. 28, 2015

(65) Prior Publication Data

US 2015/0255922 A1 Sep. 10, 2015

(30) Foreign Application Priority Data

Mar. 6, 2014 (JP) ..... 2014-043745

(51) Int. Cl.
*H01R 13/627* (2006.01)
*H01R 13/629* (2006.01)
*H01R 13/639* (2006.01)

(52) U.S. Cl.
CPC ..... *H01R 13/62922* (2013.01); *H01R 13/6272* (2013.01); *H01R 13/639* (2013.01); *H01R 13/6275* (2013.01)

(58) Field of Classification Search
CPC ..... H01R 13/6275
USPC ..... 439/352
See application file for complete search history.

(56) References Cited

U.S. PATENT DOCUMENTS 6,244,889 B1 * 6/2001 James ..... H01R 13/6275 439/258
6,589,066 B1 * 7/2003 Wu ..... H01R 13/6275 439/352

(Continued)

FOREIGN PATENT DOCUMENTS

JP 2003249307 A 9/2003
JP 2006228703 A 8/2006

(Continued)

OTHER PUBLICATIONS

Japanese Office Action dated Jan. 7, 2015 issued in Japanese Application No. 2014-043745.

*Primary Examiner* — Tho D Ta
(74) *Attorney, Agent, or Firm* — Holtz, Holtz & Volek PC

(57) ABSTRACT

A connector is mateable with a mating connector comprising a mating fitting portion and a locked portion. The connector comprises a fitted portion and a lock structure arranged in a first direction. The fitted portion is fitted to the fitting portion under a mated state where the connector is mated with the mating connector. The lock structure includes a lock member and an operation member. The lock member has an operated portion and a lock portion. The operation member has an operation portion. The lock portion locks the locked portion under the mated state. Under the mated state, when the operation portion is moved from a first position toward a second position, the operated portion is operated and moved by the operation portion. The lock portion is moved in conjunction with the operated portion along a direction perpendicular to the first direction to unlock the locked portion.

17 Claims, 10 Drawing Sheets

(56) References Cited

U.S. PATENT DOCUMENTS

| | | | | |
|---|---|---|---|---|
| 7,354,292 | B1 | 4/2008 | Lloyd et al. | |
| 7,381,078 | B2 * | 6/2008 | Mtchedlishvili ... | H01R 13/5221 439/352 |
| 7,901,226 | B2 | 3/2011 | Kotaka | |
| 8,231,400 | B2 | 7/2012 | Phillips et al. | |
| 2014/0193993 | A1 * | 7/2014 | Meng ..... | H01R 13/633 439/352 |

FOREIGN PATENT DOCUMENTS

| | | | |
|---|---|---|---|
| JP | 2009543296 | A | 12/2009 |
| JP | 2010108800 | A | 5/2010 |
| JP | 2011253812 | A | 12/2011 |

* cited by examiner

CONNECTOR MATEABLE WITH MATING CONNECTOR AND HAVING LOCK STRUCTURE INCLUDING LOCK MEMBER AND OPERATION MEMBER WHICH IS OPERABLE TO MOVE LOCK MEMBER

CROSS REFERENCE TO RELATED APPLICATIONS

An applicant claims priority under 35 U.S.C. §119 of Japanese Patent Application No. JP2014-043745 filed Mar. 6, 2014.

BACKGROUND OF THE INVENTION

This invention relates to a connector which is mateable with a mating connector and comprises a lock structure to lock a mated state.

For example, this type of connector is disclosed in JP-A 2009-543296 (Patent Document 1), the content of which is incorporated herein by reference.

As shown in. FIG. 20, a plug connector 900 (connector) disclosed in Patent Document 1 is mateable with a receptacle connector (not shown) which is located in an outer protective guide frame 950. The plug connector 900 comprises an actuator 910 and a latching arm 920. The actuator 910 and the latching arm 920 constitute a lock structure. In detail, the actuator 910 is formed with a front end portion 912 which is vertically thick. The latching arm 920 extends over the front end portion 912 of the actuator 910. The latching arm 920 has a hook 922 while the outer protective guide frame 950 is formed with an opening 952. When the plug connector 900 is mated with the receptacle connector, the hook 922 is inserted into the opening 952 so that a mated state is locked. When the actuator 910 is pulled under the mated state, the latching arm 920 is pushed by the front end portion 912 to be moved upward. As a result, the hook 922 comes off the opening 952 so that the mated state is released.

In order for the lock structure of Patent Document 1 to be workable, the plug connector 900 needs to include a movable space which is located above the latching arm 920 and within which the latching arm 920 is movable. In consideration with this movable space, the plug connector 900 increases in size in an upper-lower direction. The plug connector 900 of Patent Document 1 is therefore unsuitable for high-density packaging that arranges a plurality of connectors in high-density.

SUMMARY OF THE INVENTION

It is therefore an object of the present invention to provide a connector which comprises a lock structure that locks a mated state of the connector with a mating connector, and which is suitable for high-density packaging.

One aspect of the present invention provides a connector mateable with a mating connector comprising a mating fitting portion and a locked portion. The connector comprises a fitted portion and a lock structure. The fitted portion is fitted to the mating fitting portion under a mated state where the connector is mated with the mating connector. The fitted portion and the lock structure are arranged in a first direction. The lock structure includes a lock member and an operation member. The lock member has an operated portion and a lock portion. The lock portion is movable in a first plane perpendicular to the first direction in conjunction with the operated portion. The lock portion locks the locked portion under the mated state. The operation member has an operation portion. The operation portion is movable between a first position and a second position by a movement of the operation member. Under the mated state, when the operation portion is moved from the first position toward the second position, the operated portion is operated and moved by the operation portion, and the lock portion is moved in conjunction with the operated portion along a release direction, which is in parallel to the first plane, to unlock the locked portion.

According to the present invention, the fitted portion and the lock structure are arranged in the first direction, or in an upper-lower direction, while the lock portion of the lock member included in the lock structure is moved in the first plane, or a horizontal plane, perpendicular to the upper-lower direction. Accordingly, a movable space of the lock structure can be provided within the connector. According to the present invention, the connector can be prevented from increasing in size even in consideration of the movable space for the lock structure. The connector according to the present invention is therefore suitable for high-density packaging.

An appreciation of the objectives of the present invention and a more complete understanding of its structure may be had by studying the following description of the preferred embodiment and by referring to the accompanying drawings.

Figure 1:
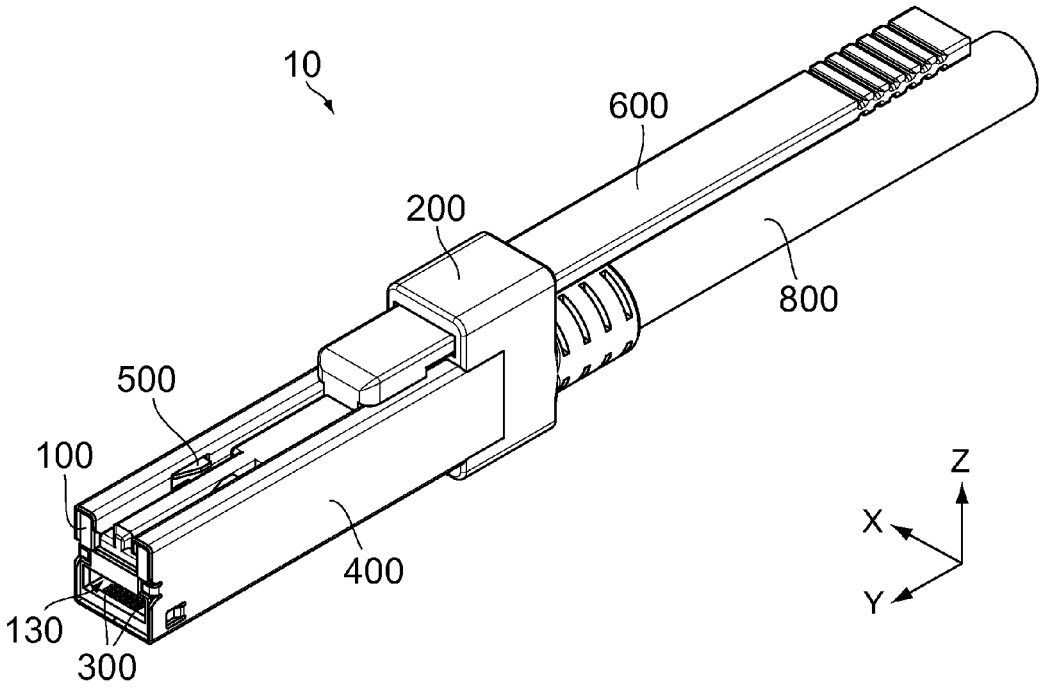
FIG. 1 is a perspective view showing a connector according to an embodiment of the present invention.
Figure 2:
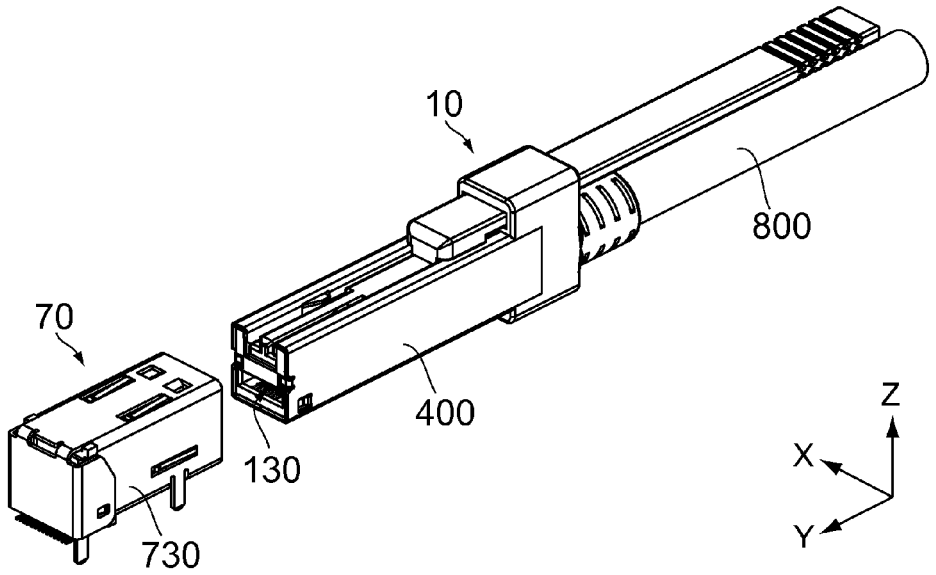
FIG. 2 is a perspective view showing the connector of FIG. 1 and a mating connector, wherein the connector is not mated with the mating connector.
Figure 3:
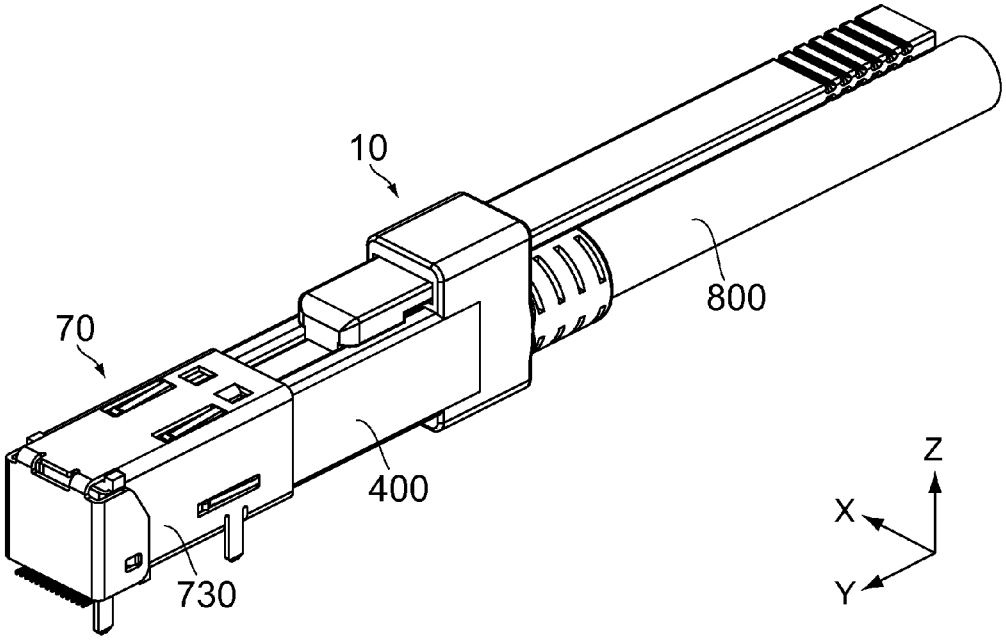
FIG. 3 is a perspective view showing the connector and the mating connector of FIG. 2, wherein the connector is mated with the mating connector.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

As shown in FIGS. 1 to 4, a connector 10 according to an embodiment of the present invention is mateable with a mating connector 70 along the Y-direction (front-rear direction). In the present embodiment, the connector 10 is a cable connector which is to be connected to a cable 800, and the mating connector 70 is an on-board connector which is to be mounted on a circuit board (not shown).

Figure 4:
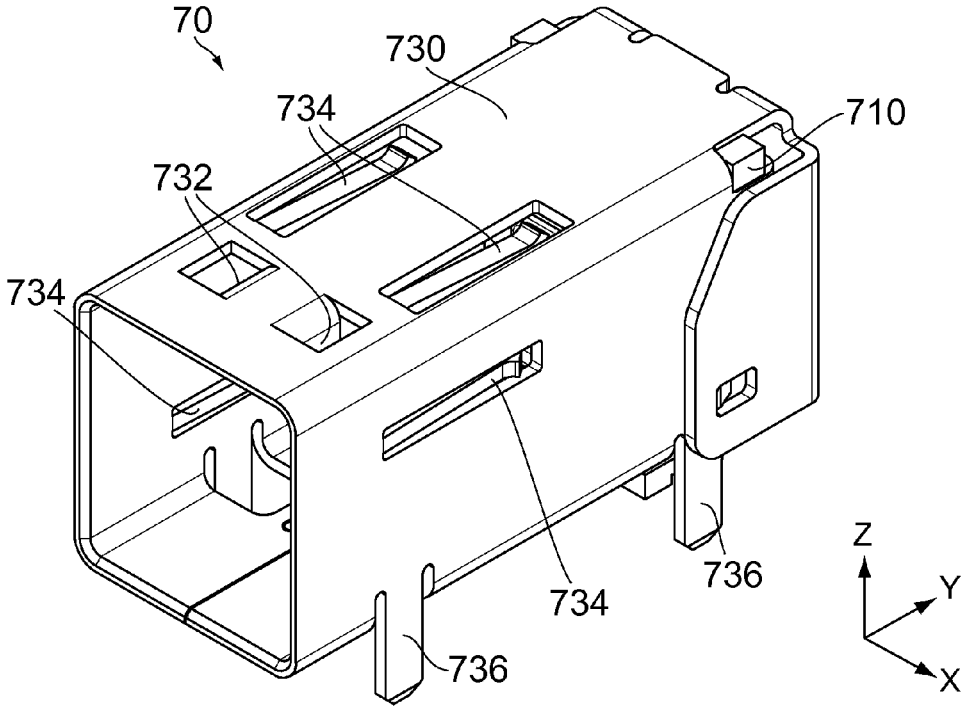
FIG. 4 is a perspective view showing the mating connector of FIG. 2.
Figure 5:
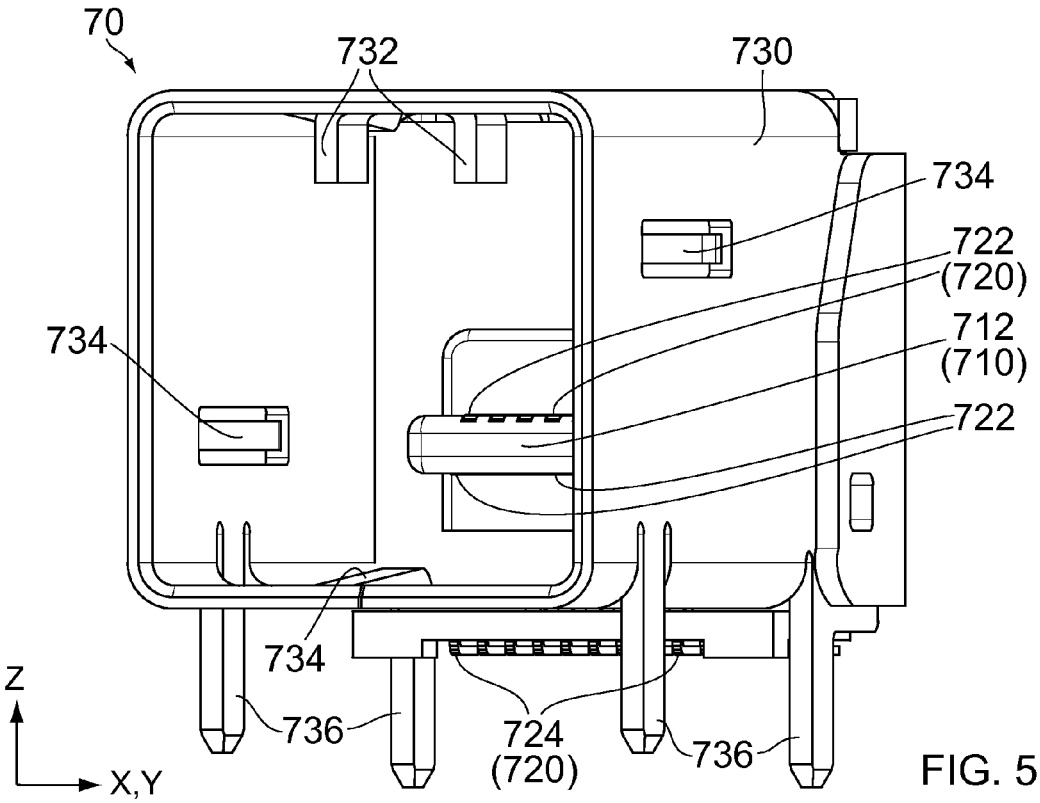
FIG. 5 is a perspective view obliquely showing the mating connector of FIG. 4 from front.

As shown in FIGS. 4 and 5, the mating connector 70 comprises a mating housing 710 made of insulator, a plurality of mating contacts 720 each made of conductor and a mating shell 730 made of metal. The mating housing 710 has a plate-like portion (mating fitting portion) 712 which is perpendicular to the Z-direction (upper-lower direction).

As shown in FIG. 5, each of the mating contacts 720 has a contact portion 722 and a fixed portion 724. The contact portions 722 are arranged in the X-direction (pitch direction) on each of an upper surface (positive Z-side surface) and a lower surface (negative Z-side surface) of the plate-like portion 712. The fixed portions 724 extend downward, or in the negative Z-direction, to be connected to conductive patterns (not shown) of the circuit board (not shown).

As shown in FIGS. 4 and 5, the mating shell 730 covers the mating housing 710. The mating shell 730 is formed with two locked portions 732, a plurality of contact pieces 734 and a plurality of fixed portions 736. The locked portions 732 extend downward within the mating connector 70 from an upper surface of the mating shell 730. Each of the contact pieces 734 is resiliently deformable. The fixed portions 736 extend downward to be connected and grounded to pads (not shown) of the circuit board (not shown) via soldering or the like.

As shown in FIG. 1, the connector 10 according to the present embodiment comprises a housing 100 made of insulator, a holding member 200 made of insulator, a plurality of contacts 300 each made of conductor, a shell 400 made of metal, a lock member 500 made of metal and an operation member 600 made of insulator. In addition, referring to FIG. 8, the connector 10 comprises two spring members 290 each made of metal.

Figure 7:
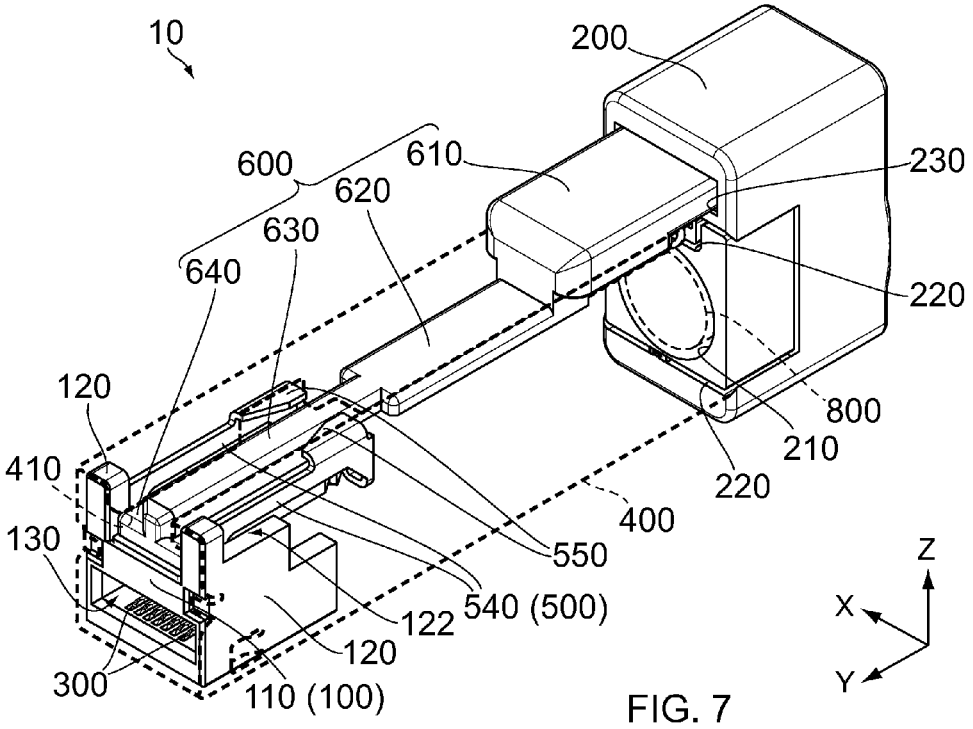
FIG. 7 is a perspective view showing a part of the connector of FIG. 1, wherein an outline of a shell and an outline of a cross-section of a cable are illustrated by dashed line.

As shown in FIG. 7, the housing 100 has a body portion 110 and two sidewalls 120. The body portion 110 is formed with a fitted portion 130. The fitted portion 130 is a space having a shape which corresponds to that of the plate-like portion 712 (see FIG. 5) of the mating connector 70. The fitted portion 130 opens forward, or in the positive Y-direction. The sidewalls 120 are located at opposite sides of the body portion 110 in the X-direction (pitch direction: third direction), respectively. Each of the sidewalls 120 is lowered stepwise from its front end (positive Y-side end) toward its rear end (negative Y-side end) so that the housing 100 is formed with two movable spaces 122. Each of the movable spaces 122 is an inside space of the connector 10 and is located on an upper surface of the corresponding sidewall 120.

Figure 11:
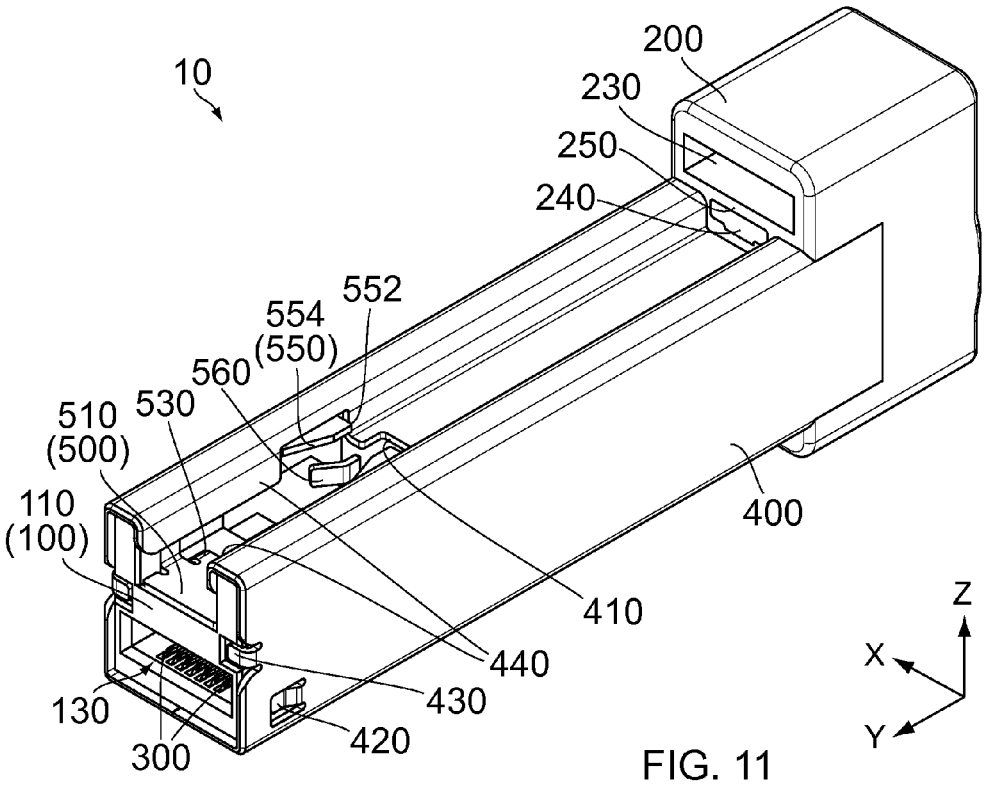
FIG. 11 is a perspective view showing a part of the connector of FIG. 1, wherein the operation member of the connector is not illustrated.

As shown in FIG. 1, the holding member 200 includes a front portion (positive Y-side portion) having a block-like shape and a rear portion (negative Y-side portion) having a cylindrical shape. Referring to FIGS. 7 and 11, the holding member 200 is formed with an insertion hole 210, an attachment groove 220, a holding hole 230, a receive hole 240 and a second stopper 250. Referring to FIGS. 1 and 7, the insertion hole 210 pierces the front portion and the rear portion of the holding member 200 in the Y-direction (front-rear direction: second direction). The cable 800 is inserted in the insertion hole 210. Referring to FIGS. 7 and 11, the attachment groove 220 is formed to surround the insertion hole 210. The holding hole 230 is formed in the vicinity of an upper end (positive Z-side end) of the front portion of the holding member 200. The holding hole 230 pierces the front portion of the holding member 200 in the Y-direction.

Referring to FIG. 11, the receive hole 240 is located under the holding hole 230. The receive hole 240 is a recess which is recessed rearward, or in the negative Y-direction, and which opens forward. The receive hole 240 receives an end of each of the spring members 290 (see FIGS. 8 and 9). The second stopper 250 is a part of a front surface (positive Y-side surface) of the holding member 200. The second stopper 250 is located between the holding hole 230 and the receive hole 240 in the Z-direction (upper-lower direction: first direction).

Figure 12:
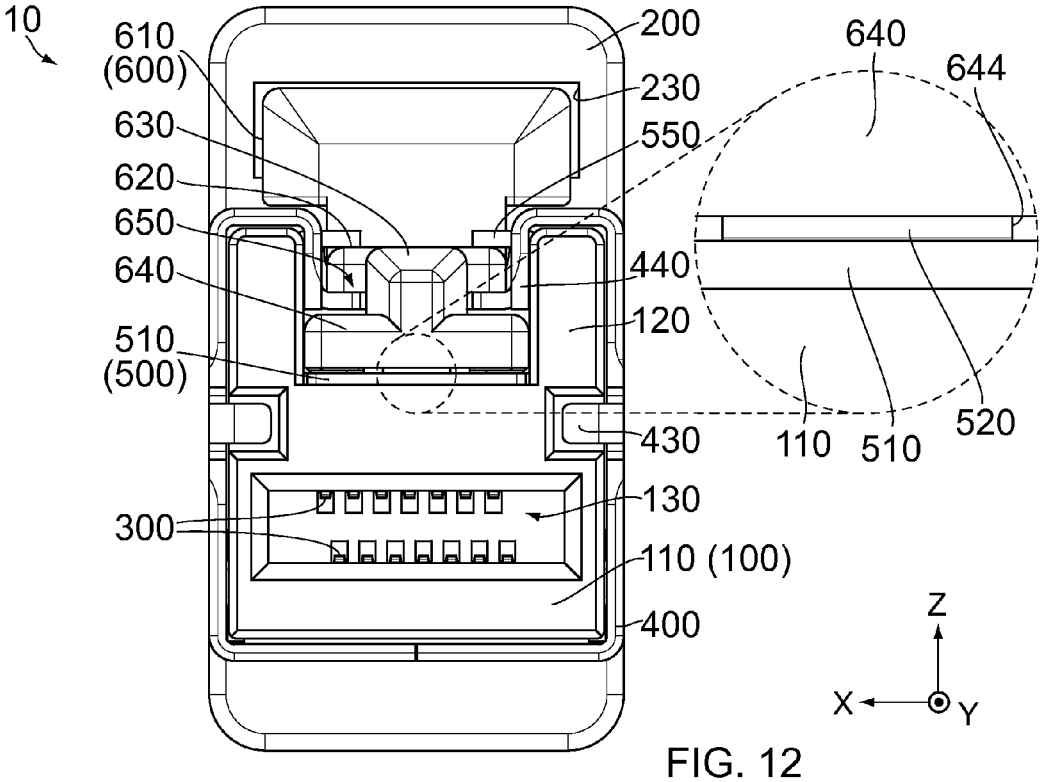
FIG. 12 is a front view showing the connector of FIG. 1, wherein the vicinity of a first stopper of the lock member (the part encircled by dashed line) is enlarged to be illustrated.

Referring to FIGS. 7 and 12, the contacts 300 are arranged in the X-direction on each of an upper surface and a lower surface of the fitted portion 130. Each of the contacts 300 extends in the Y-direction. Each of the contacts 300 has an end which is connected to a corresponding signal line (not shown) of the cable 800.

As shown in FIGS. 7 and 11, the shell 400 is attached to the housing 100 and the holding member 200. The shell 400 has a rear end portion which is inserted in the attachment groove 220 to be connected to a ground line (not shown) of the cable 800. The shell 400 roughly has a rectangular cylindrical shape. However, the shell 400 has an upper surface which is recessed downward at its middle part in the X-direction to be formed with a ditch extending along the Y-direction.

As shown in FIG. 11, the shell 400 is formed with a cut 410, two attached portions 420, two attached portions 430 and two protruding portions 440. The shell 400 covers the fitted portion 130 of the housing 100. In detail, the shell 400 except the cut 410 and openings around the attached portions 420 covers between a front end of the housing 100 and the holding member 200 without any gap.

The cut 410 is formed at the upper surface of the shell 400. The cut 410 cuts the upper surface of the shell 400 from front. The attached portions 420 are located at opposite sides of the fitted portion 130 in the X-direction, respectively. The attached portions 430 are located at the front ends of the two sidewalls 120 of the housing 100, respectively. The protruding portions 440, or parts of the shell 400, protrude inward in the X-direction from opposite side surfaces of the shell 400 in the X-direction, respectively, to extend downward. The protruding portions 440 extend rearward from a front end of the shell 400.

Figure 13:
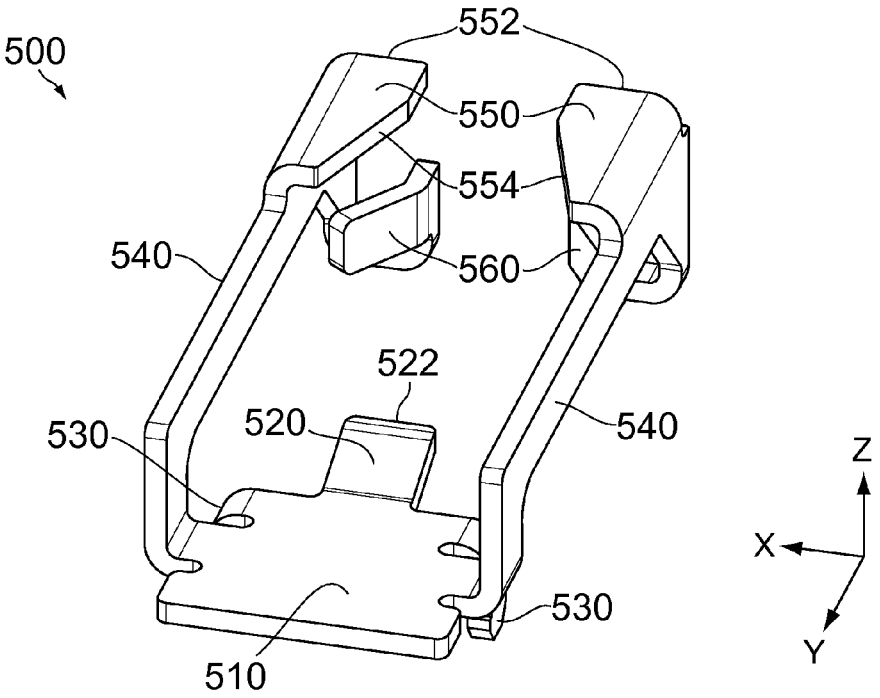
FIG. 13 is a perspective view showing the lock member of the connector of FIG. 1.

As shown in FIG. 13, the lock member 500 according to the present embodiment is formed by punching and bending a single metal plate. The lock member 500 has a base portion 510 and two spring portions 540. The base portion 510 has a plate-like shape extending along the X-direction and the Y-direction. The spring portions 540 are located at opposite sides of the base portion 510 in the X-direction, respectively, and extend rearward. Each of the spring portions 540 is resiliently deformable in a horizontal plane (first plane) perpendicular to the Z-direction.

The base portion 510 is formed with a projecting piece 520 and two held portions 530. The projecting piece 520 extends rearward from a rear end of the base portion 510 while sloping upward, or in the positive Z-direction. The projecting piece 520 has a first stopper 522 formed at a rear end thereof. The first stopper 522 according to the present embodiment is an edge surface perpendicular to the Y-direction. The held portions 530 are located at opposite sides of the base portion 510 in the X-direction, respectively.

Each of the spring portions 540 is provided with a hook 550 and an operated portion 560. The hook 550 is located above the operated portion 560. Each of the hook 550 and the operated portion 560 is supported by the spring portion 540 to be movable in the horizontal plane (first plane).

The hook 550 is formed with a lock portion 552 and a pressed portion 554. According to the present embodiment, each of the lock portion 552 and the pressed portion 554 is a part of the hook 550. In detail, the lock portion 552 is a rear edge surface of the hook 550, and the pressed portion 554 is a front edge surface of the hook 550. Each of the lock portion 552 and the pressed portion 554 intersects with the Y-direction. In particular, in the present embodiment, the lock portion 552 is perpendicular to the Y-direction while the pressed portion 554 is oblique to the Y-direction. The operated portion 560 intersects with the Y-direction. In particular, the operated portion 560 according to the present embodiment is oblique to the Y-direction.

Since the hook 550 and the operated portion 560 are supported by the common spring portion 540, the hook 550 and the operated portion 560 are moved in conjunction with each other. In detail, the lock portion 552 according to the present embodiment is movable in the horizontal plane (first plane) in conjunction with the operated portion 560. However, a moving direction of the operated portion 560 does not need to extend along the horizontal plane, provided that the lock portion 552 is moved in the horizontal plane in conjunction with the operated portion 560. For example, the operated portion 560 may be moved upward and toward the hook 550 while being moved in the horizontal plane.

Referring to FIGS. 11 to 13, the base portion 510 of the lock member 500 is fixed on the body portion 110 of the housing 100. In detail, the held portions 530 of the base portion 510 are attached to the body portion 110. Moreover, the base portion 510 is sandwiched in the X-direction by the sidewalls 120 of the housing 100. Referring to FIG. 7, the spring portions 540 of the lock member 500 extend rearward in parallel to each other from the base portion 510 which is fixed on the body portion 110. Each of the spring portions 540 is resiliently deformable within the corresponding movable space 122. Referring to FIG. 11, each of the hooks 550 is located rearward of the corresponding protruding portion 440 of the shell 400 and projects inward in the X-direction beyond the corresponding protruding portion 440.

Figure 14:
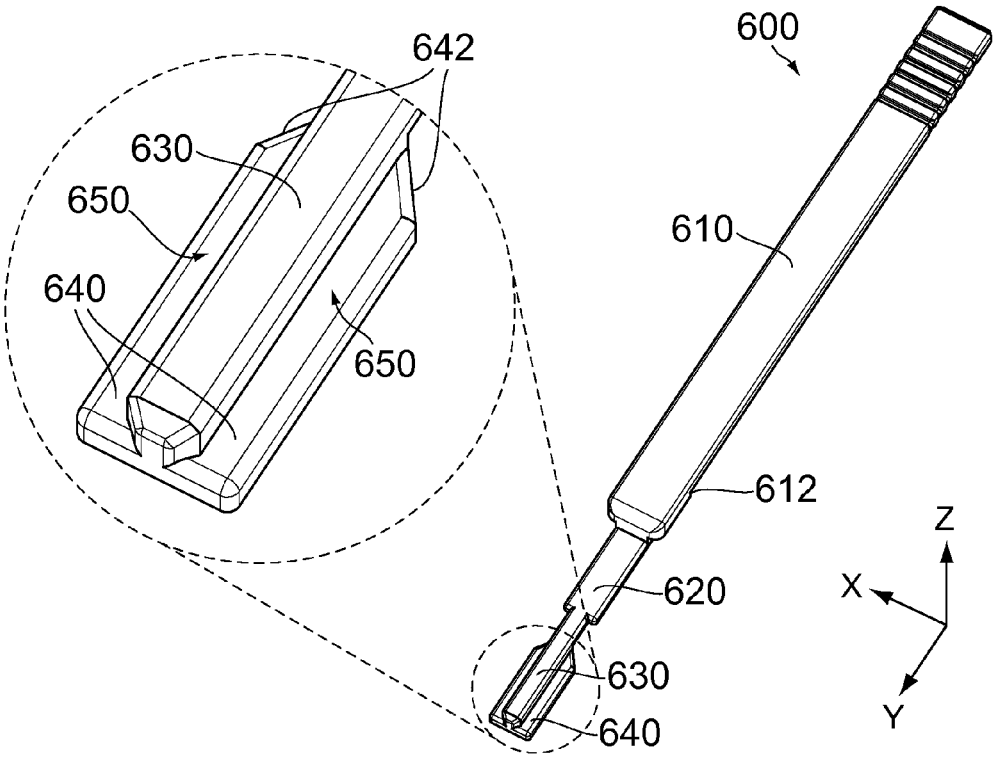
FIG. 14 is an upper perspective view showing the operation member of the connector of FIG. 1, wherein the vicinity of the operation portion (the part encircled by dashed line) is enlarged to be illustrated.
Figure 15:
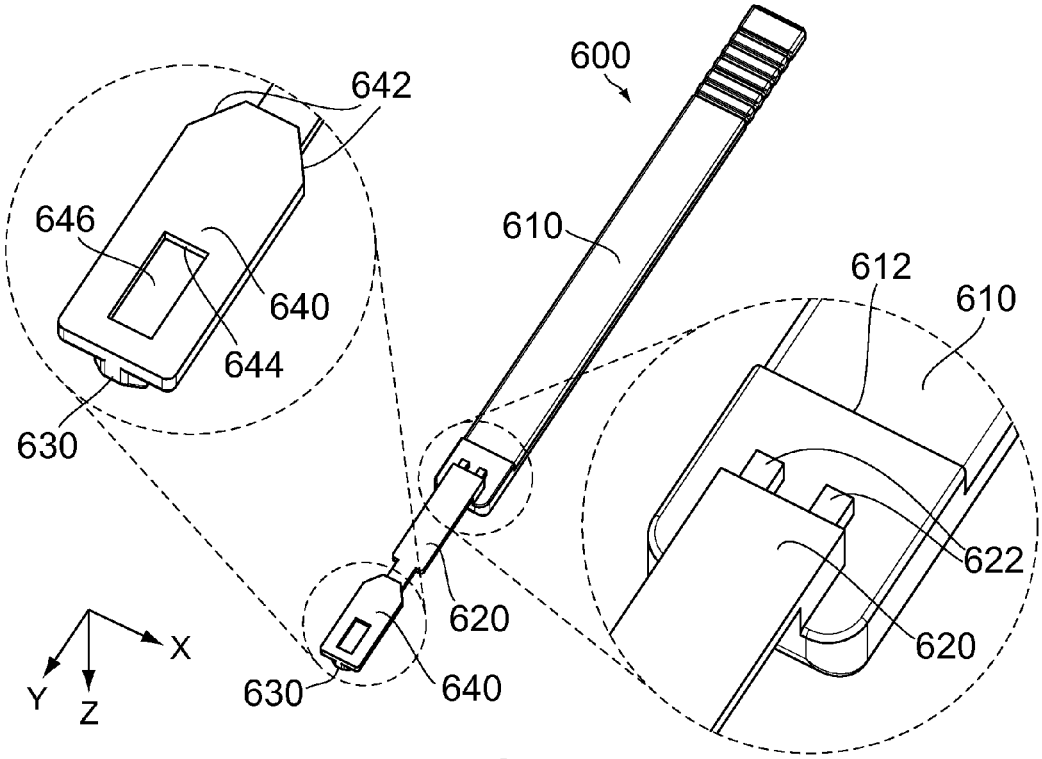
FIG. 15 is a lower perspective view showing the operation member of FIG. 14, wherein each of the vicinity of the operation portion (the part encircled by dashed line) and the vicinity of a second stopped portion (the part encircled by other dashed line) is enlarged to be illustrated.
Figure 16:
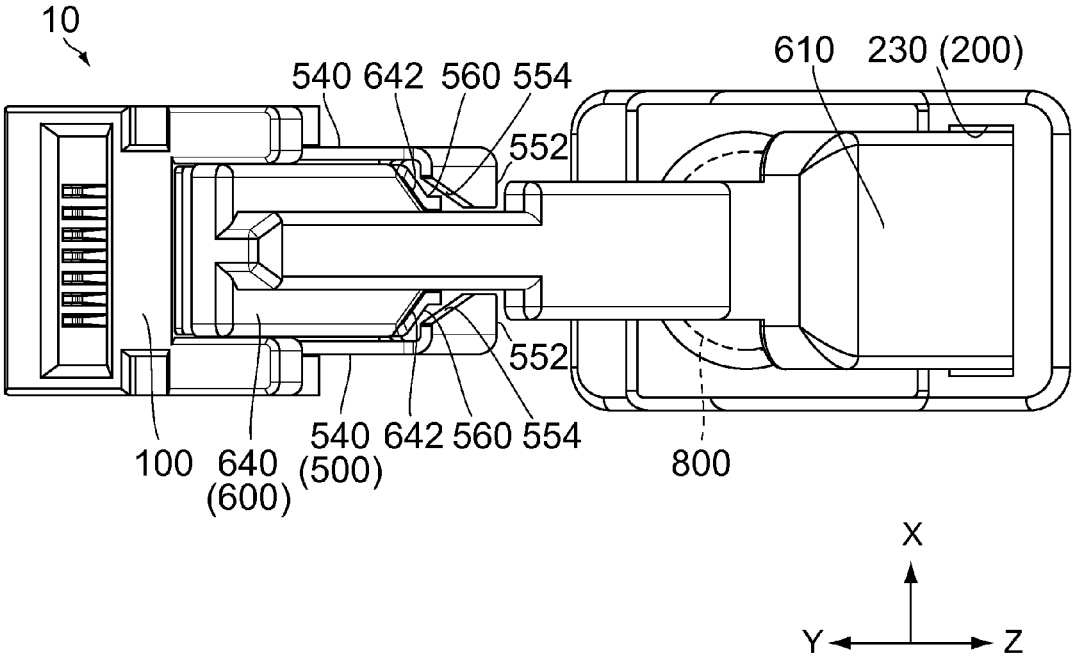
FIG. 16 is a perspective view obliquely showing a part of the connector of FIG. 1 from above, wherein the shell is not illustrated, an outline of a cross-section of the cable is illustrated by dashed line, and the operation portion of the operation member is located at the first position.

As shown in FIGS. 14 and 15, the operation member 600 has a held portion 610, a coupling portion 620, a protruding portion 630 and a primary portion 640. The held portion 610 extends in the Y-direction. An operator can pull the operation member 600 by using a rear end portion of the held portion 610 (see FIG. 1). Referring to FIG. 15 which shows the operation member 600 from its lower side, the held portion 610 has a front end portion which protrudes downward. The coupling portion 620 is located under the held portion 610 and extends forward from a lower surface of the front end portion of the held portion 610. The protruding portion 630 extends forward from a front end of the coupling portion 620. The primary portion 640 is provided at a front part of the protruding portion 630. Referring to the enlarged view in FIG. 14, the primary portion 640 is located under the protruding portion 630. The primary portion 640 has opposite side portions which are located at opposite sides thereof in the X-direction, wherein the side portions protrude outward in the Y-direction from the protruding portion 630.

As can be seen from FIGS. 1, 7 and 11, the held portion 610 is inserted into the holding hole 230 from front to pierce the holding hole 230 in the Y-direction. As a result, the operation member 600 is attached to the holding member 200 so that the coupling portion 620, the protruding portion 630 and the primary portion 640 extend along the ditch of the upper surface of the shell 400. The primary portion 640 is located below the cut 410 of the shell 400.

Referring to FIGS. 12 and 14, the protruding portion 630 of the operation member 600 protrudes upward from the primary portion 640 so as to form two guide portions 650. In other words, the operation member 600 has the protruding portion 630 protruding in the Z-direction and the guide portions 650 recessed in the Z-direction. Each of the guide portions 650 is located between the protruding portion 630 and the protruding portion 440 of the shell 400 in the X-direction. The guide portions 650 extend along the Y-direction. The protruding portion 630 reinforcements the primary portion 640 so that the primary portion 640 is hardly damaged.

Figure 6:
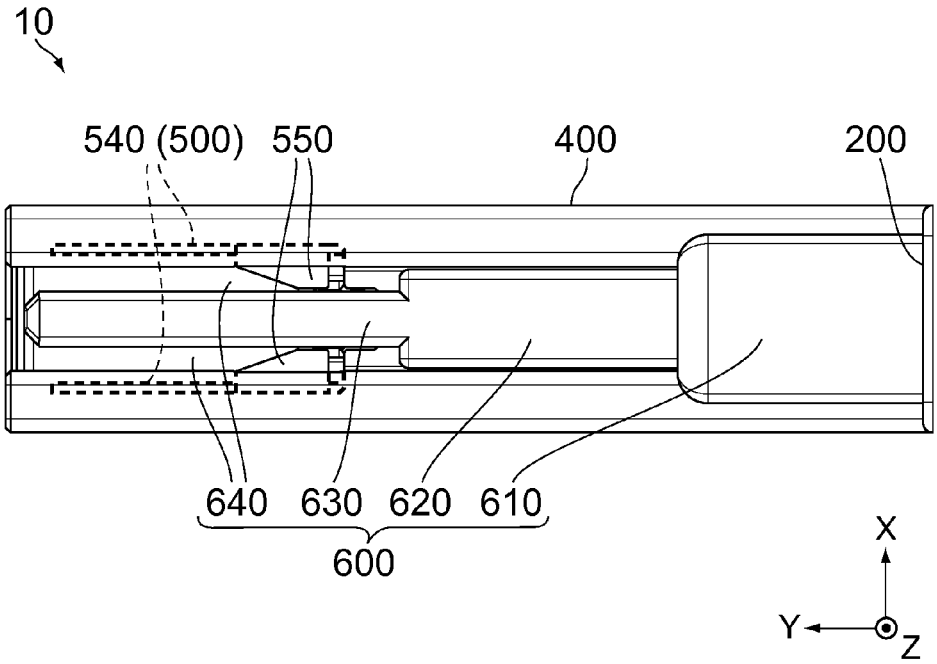
FIG. 6 is a top view showing a part of the connector of FIG. 1, wherein hidden outlines of spring portions of a lock member are illustrated by dashed line.
Figure 10:
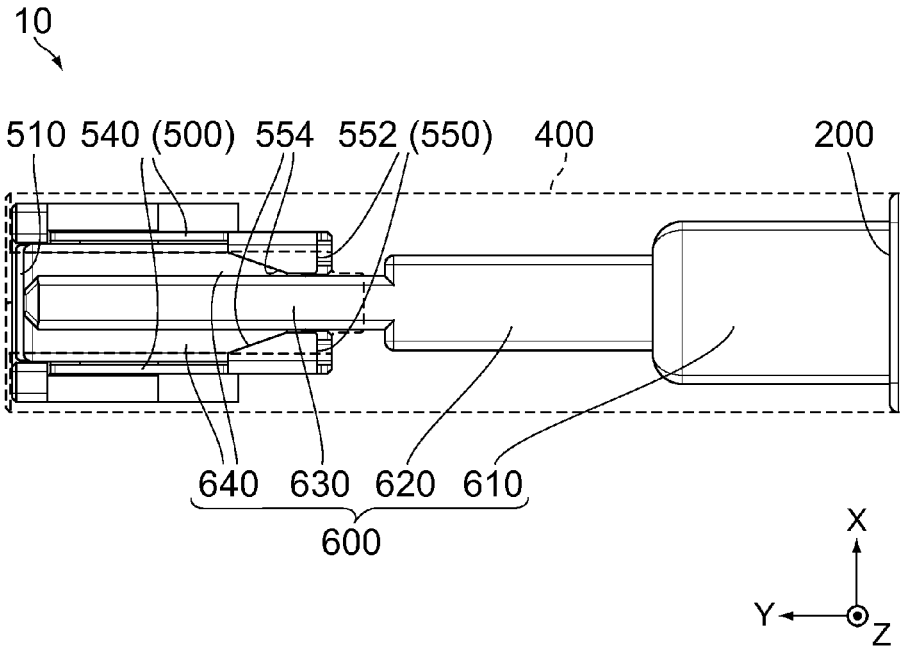
FIG. 10 is a top view showing a part of the connector of FIG. 7.

As shown in FIGS. 6 and 10, the lock member 500 is covered by the operation member 600 and the shell 400 to be invisible except the hooks 550 when seen from above along the Z-direction. In other words, the most part of the lock member 500 is covered from above so that the lock member 500 is prevented from being damaged.

Figure 8:
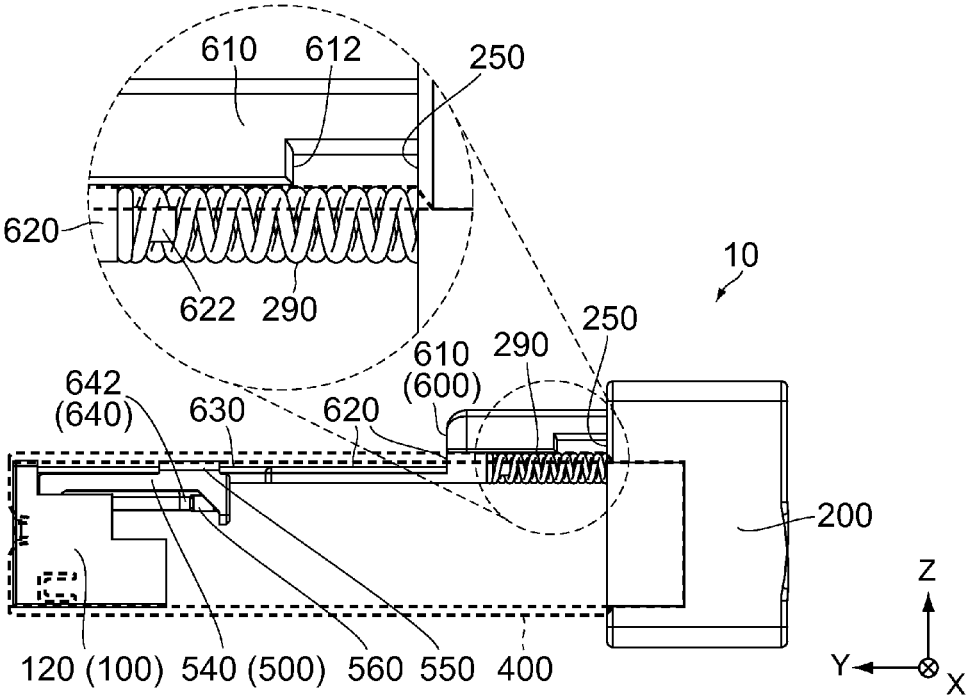
FIG. 8 is a side view showing the connector of FIG. 7, wherein the vicinity of a spring member (the part encircled by dashed line) is enlarged to be illustrated, and an operation portion of an operation member is located at a first position.

As shown in FIG. 15, the held portion 610 is formed with a second stopped portion 612. The second stopped portion 612 according to the present embodiment is perpendicular to the Y-direction. As shown in FIG. 8, the second stopped portion 612 is located forward of the second stopper 250 of the holding member 200.

As shown in FIGS. 8 and 15, the coupling portion 620 is formed with two support projections 622. The support projections 622 are arranged in the X-direction and project rearward from a rear end of the coupling portion 620. The support projections 622 support the spring members 290 together with the receive hole 240 (see FIG. 11). In detail, each of the spring members 290 has a front end and a rear end in the Y-direction, and can be compressed and stretched in the Y-direction. The front end of the spring member 290 is attached to and supported by the support projection 622 while the rear end of the spring member 290 is inserted in and supported by the receive hole 240.

As shown in FIG. 15, the primary portion 640 is formed with two operation portions 642 and a first stopped portion 644. The operation portions 642 are rear edge surfaces of the side portions of the primary portion 640, respectively. Each of the operation portions 642 intersects with the Y-direction. In particular, the operation portion 642 according to the present embodiment is oblique to the Y-direction. The primary portion 640 is formed with a recess 646 which is recessed upward. The first stopped portion 644 according to the present embodiment is a rear wall surface of this recess 646.

As can be seen from FIGS. 12, 13 and 15, the projecting piece 520 of the lock member 500 is inserted in the recess 646 of the primary portion 640 of the operation member 600 so that the first stopper 522 is located forward of the first stopped portion 644.

Referring to FIG. 8, the spring members 290 push the coupling portion 620 of the operation member 600 forward while the first stopper 522 (see FIG. 13) stops the first stopped portion 644 (see FIG. 15). The position of a pair of the operation portions 642 at that time is referred to as a first position. The operation portions 642 at the first position are located forward of the operated portions 560 of the lock member 500, respectively. The spring member 290 applies a force to the operation member 600 to urge the operation portions 642 to be moved toward the first position. On the other hand, the first stopper 522 stops the first stopped portion 644 to prevent the operation portions 642 from being moved beyond the first position.

Referring to FIG. 13, the first stopper 522 according to the present embodiment is a part of the lock member 500. However, the first stopper 522 may be a member separated from the lock member 500 or may be a part of a member other than the lock member 500, provide that the first stopped portion 644 (see FIG. 15) can be stopped.

Figure 9:
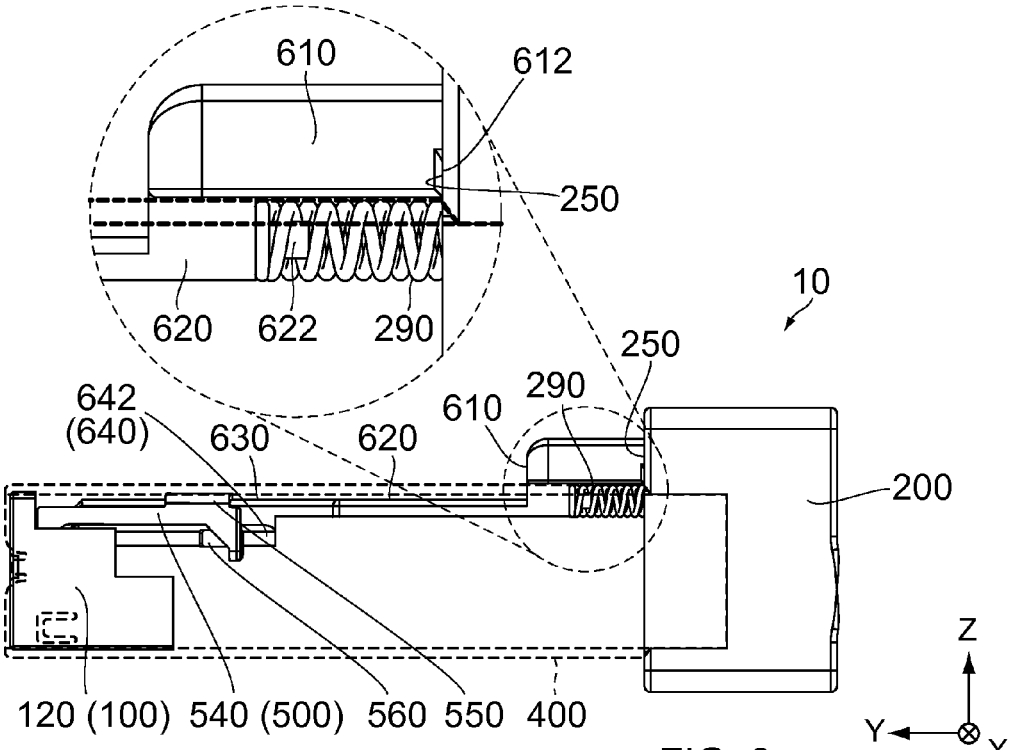
FIG. 9 is a side view showing the connector of FIG. 8, wherein the vicinity of the spring member (the part encircled by dashed line) is enlarged to be illustrated, and the operation portion of the operation member is located at a second position.

Referring to FIGS. 8 and 9, when the operation portions 642 are located at the first position, the operation member 600 is movable rearward. When the operation member 600 is moved rearward, the second stopped portion 612 is brought into abutment with the second stopper 250 so that the movement of the operation member 600 is stopped. The position of the pair of the operation portions 642 at that time is referred to as a second position. The holding member 200 holds the operation member 600 while allowing the operation portions 642 to be moved between the first position (see FIG. 8) and the second position (see FIG. 9). In other words, the operation portions 642 are movable between the first position and the second position along the Y-direction by the movement of the operation member 600. When the operation member 600 is moved, the second stopper 250 stops the second stopped portion 612 to prevent the operation portions 642 from being moved beyond the second position.

Referring to FIG. 11, the second stopper 250 according to the present embodiment is a part of the holding member 200. However, the second stopper 250 may be a member separated from the holding member 200 or may be a part of a member other than the holding member 200, provide that the second stopped portion 612 can be stopped.

Referring to FIG. 8, each of the spring members 290 according to the present embodiment is a coil spring. However, the spring member 290 may be a spring other than the coil spring or may be formed to pull the operation member 600 forward, provide that the spring member 290 can apply a forward force to the operation member 600.

Hereafter, explanation is made about a mating operation for mating the connector 10 with the mating connector 70.

Figure 18:
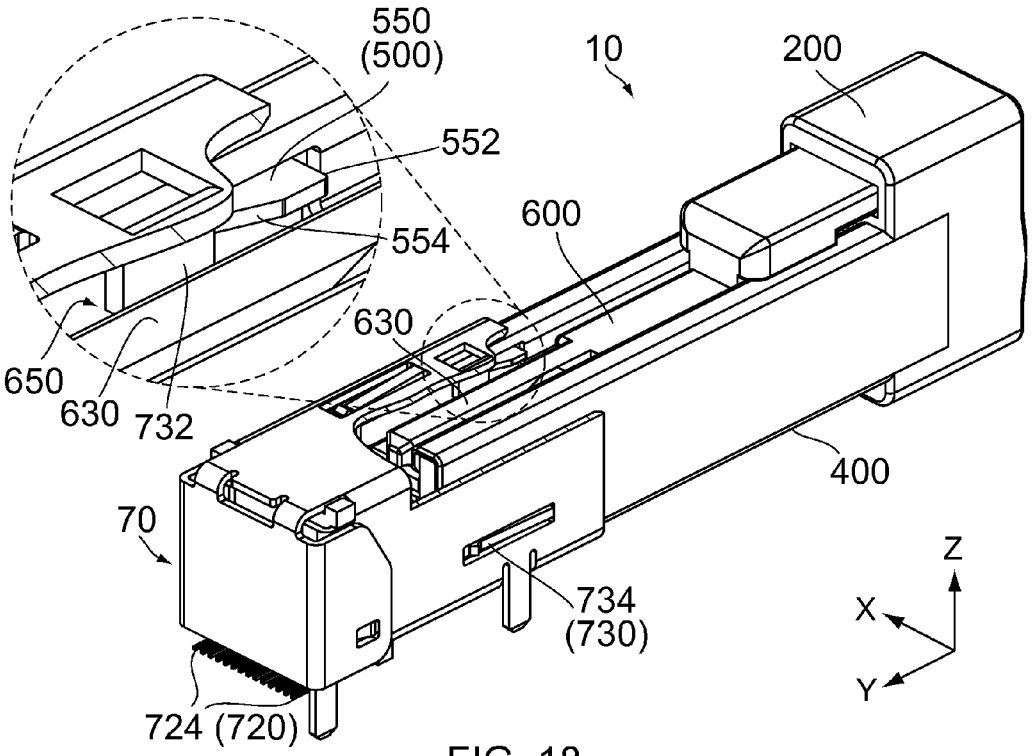
FIG. 18 is a perspective view showing a part of the connector of FIG. 1 and the mating connector of FIG. 4, wherein the mating connector is partially cut to be illustrated, the vicinity of the locked portion of the mating connector (the part encircled by dashed line) is enlarged to be illustrated, and the connector is inserted in the mating connector while being not mated with the mating connector.

Referring to FIG. 18, when the connector 10 starts to be mated with the mating connector 70, the connector 10 is firstly inserted into the mating connector 70. In detail, the locked portions 732 of the mating connector 70 are inserted into the guide portions 650, respectively, to be moved along the guide portions 650.

Figure 19:
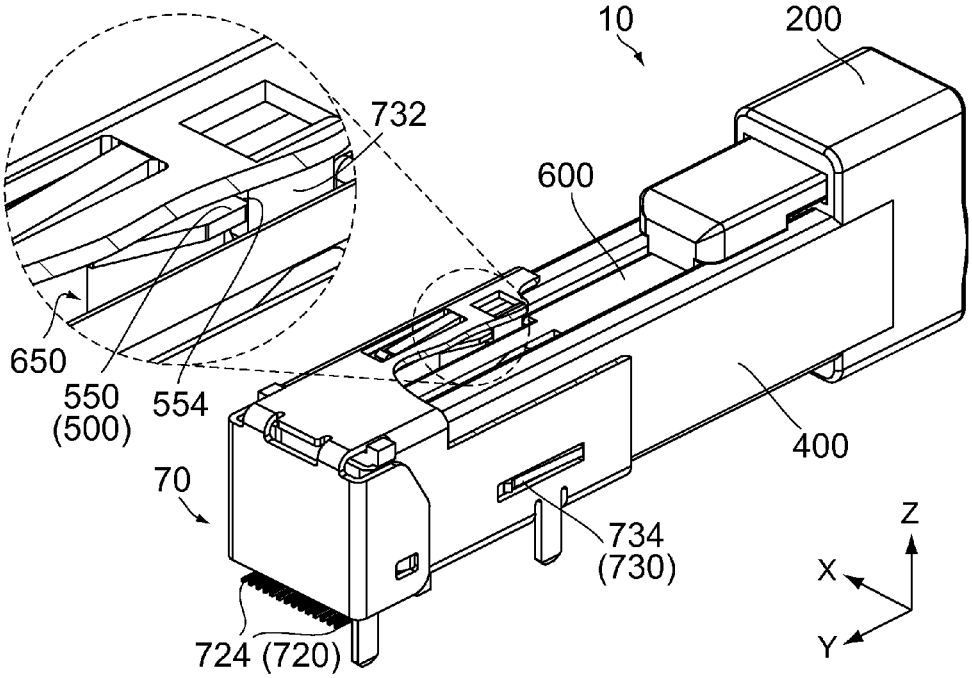
FIG. 19 is a perspective view showing the connector and the mating connector of FIG. 18, wherein the mating connector is partially cut to be illustrated, the vicinity of the locked portion of the mating connector (the part encircled by dashed line) is enlarged to be illustrated, and the connector is mated with the mating connector.
Figure 20:
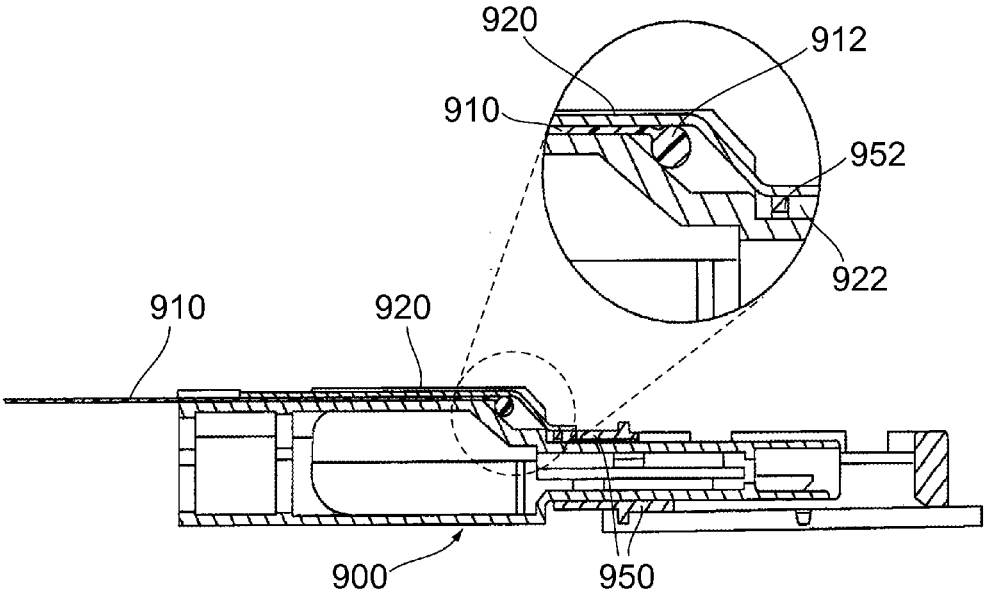
FIG. 20 PRIOR ART
FIG. 20 is a cross-sectional view showing a plug connector and an outer protective guide frame of Patent Document 1.

Referring to FIGS. 18 and 19, the pressed portion 554 of each of the hooks 550 protrudes into the corresponding guide portion 650. Accordingly, when the connector 10 is inserted into the mating connector 70, the locked portion 732 is brought into abutment with the pressed portion 554. Since the pressed portion 554 is inclined inward in the X-direction, the pressed portion 554 is pressed by the locked portion 732 in a direction which is in parallel to the horizontal plane (first plane) and intersects with the Y-direction. Accordingly, the hook 550 is moved outward in the X-direction from its initial position in the horizontal plane to allow the locked portion 732 to pass therethrough.

Referring to FIG. 19, when the connector 10 is further inserted into the mating connector 70, the locked portion 732 completely passes over the hook 550. Accordingly, the hook 550 returns to the initial position by the spring force of the spring portion 540 so that the locked portion 732 is located behind the lock portion 552. At that time, the connector 10 is in a mated state where the connector 10 is mated with the mating connector 70. Under the mated state, even when the connector 10 is pulled rearward, the lock portions 552 are brought into abutment with the locked portions 732, respectively, so that the connector 10 is prevented from being removed. In other words, the lock portions 552 lock the locked portions 732 under the mated state, respectively.

Referring to FIGS. 1, 5 and 19, the fitted portion 130 is fitted to the plate-like portion 712 of the mating connector 70 under the mated state. In detail, the contacts 300 are connected to the mating contacts 720, respectively. The contact pieces 734 of the mating shell 730 are brought into contact with the shell 400 under the mated state. Moreover, under the mated state, the shell 400 and the mating shell 730 cover upper and lower portions, side portions and a front portion of the connector 10 and the mating connector 70 with little gap. Accordingly, electromagnetic interference (EMI) can be securely prevented.

Referring to FIG. 18, the lock portion 552 is located at a deep side (negative Y-side) of the guide portion 650 in the Y-direction. More specifically, the lock portion 552 is located in the vicinity of a rear end of the spring portion 540 which extends rearward. Accordingly, while the connector 10 is mated with the mating connector 70, the locked portion 732 of the mating connector 70 is moved to the deep side of the guide portion 650 along the guide portion 650. As can be seen from this structure, each of the guide portions 650 according to the present embodiment also functions as a key that prevent incorrect insertion of the mating connector 70.

Hereafter, explanation is made about a removing operation for removing the connector 10 from the mating connector 70.

Figure 17:
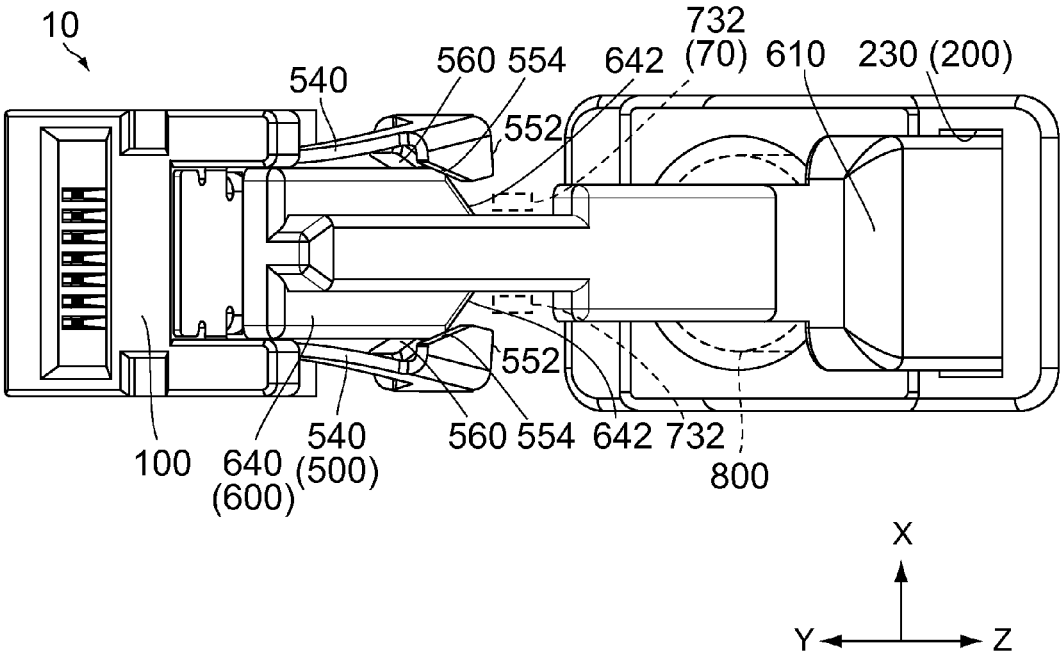
FIG. 17 is a perspective view obliquely showing the connector of FIG. 16 from above, wherein the shell is not illustrated, an outline of a cross-section of the cable is illustrated by dashed line, positions of locked portions are illustrated by dashed line under a state where the connector is mated with the mating connector, and the operation portion of the operation member is located at the second position.

As can be seen from FIGS. 17 and 19, under the mated state, the operation member 600 can be pulled rearward. When the operation member 600 is pulled rearward, the operation portions 642 are moved from the first position toward the second position to be brought into abutment with the operated portions 560, respectively. Each of the operated portions 560 is operated to be pressed by the corresponding operation portion 642 and moved in a predetermined direction in parallel to the horizontal plane (first plane). The operation portions 642 according to the present embodiment are inclined so as to correspond to the operated portions 560, respectively. Accordingly, the operated portions 560 are moved smoothly. Each of the lock portions 552 is moved in conjunction with the corresponding operated portion 560 along a release direction in parallel to the horizontal plane. As a result, the lock portions 552 are not located in front of the locked portions 732, respectively, so that the locked portions 732 are unlocked.

As shown in FIG. 12, the held portion 610 of the operation member 600 is inserted in the holding hole 230 with only a slight gap. Accordingly, even if a direction, along which the operation member 600 is pulled rearward, is inclined upward, the coupling portion 620 is hardly moved upward. Moreover, the protruding portions 440 of the shell 400 cover the side portions of the primary portion 640 of the operation member 600 from above, or from outside in the Z-direction, respectively, wherein the side portions are located at opposite sides of the primary portion 640 in the X-direction. Accordingly, the primary portion 640 is moved so as to smoothly slide on the base portion 510 of the lock member 500 without being moved upward beyond the protruding portions 440.

The coupling portion 620 is located within the ditch of the upper surface of the shell 400 with only slight gaps in the X-direction. In addition, the primary portion 640 is located between the sidewalls 120 of the housing 100 with only slight gaps in the X-direction. Accordingly, when the operation member 600 is pulled, the primary portion 640 is moved on the base portion 510 while not shifted in the X-direction almost at all.

As can be seen from FIG. 9, when the operation member 600 is further pulled rearward, the second stopped portion 612 is stopped by the holding member 200 so that the holding member 200 receives a rearward force. As a result, the whole of the connector 10 is moved rearward to be removed from the mating connector 70. Thus, the mated state is released. As can be seen from the above explanation, according to the present embodiment, the connector 10 under the mated state can be removed from the mating connector 70 only by pulling the operation member 600 rearward.

When the pulling of the operation member 600 is stopped after the removal of the connector 10 from the mating connector 70, the operation member 600 is pushed by the spring members 290 so that the operation portions 642 return to the first position. In addition, under a state where the connector 10 is removed from the mating connector 70, even if the operation member 600 is kept to be held, the holding member 200 is pushed by the spring members 290 so that the operation portions 642 return to the first position. When the operation portions 642 return to the first position, each of the hooks 550 of the lock member 500 returns to the initial position.

Referring to FIG. 1, as can be seen from the above explanation, the lock member 500 and the operation member 600 form a lock structure for locking and unlocking the mated state of the connector 10. In other words, the connector 10 according to the present embodiment comprises the lock structure which includes the lock member 500 and the operation member 600. The fitted portion 130 and the lock structure are arranged in the Z-direction.

More specifically, the lock structure is located above the fitted portion 130. Accordingly, the lock structure does not affect a width, or a size in the X-direction, of the connector 10. Moreover, a height, or a size in the Z-direction, of the connector 10 does not become so large in comparison with another size of the cable 800 even when the lock structure is provided. In short, the lock structure according to the present embodiment does not largely affect the size of the connector 10.

Moreover, each of movable portions (the lock portions 552, the pressed portions 554 and the operated portions 560) of the lock member 500 is moved along a direction in parallel to the horizontal plane (first plane) within the connector 10. In particular, according to the present embodiment, each of the movable portions is moved within the movable space 122 shown in FIG. 7. The movable spaces 122 of the lock structure according to the present embodiment do not make the size of the connector 10 larger. The connector 10 is therefore suitable for high-density packaging.

The connector 10 according to the present embodiment can be variously modified as explained below.

Referring to FIG. 17, each of the lock portions 552 according to the present embodiment are moved along the X-direction. In other words, the release direction according to the present embodiment is perpendicular to the Y-direction. However, it is sufficient that the release direction intersects with the Y-direction. Moreover, the moving direction (predetermined direction) of each of the operated portions 560 according to the present embodiment is the release direction. However, the predetermined direction may intersect with the release direction. Moreover, according to the present embodiment, the operated portions 560 are operated to be pressed by the operation portions 642, respectively. However, the operated portions 560 may be operated differently.

Referring to FIG. 10, the connector 10 according to the present embodiment has two lock sets each of which is constituted of the operated portion 560, the lock portion 552 and the operation portion 642. The lock sets are located at opposite sides of the lock member 500 in the X-direction. It is possible to provide only one lock set.

However, in a view point of preventing the locked portions 732 from coming off even under a state where the mating connector 70 (see FIG. 19) is swayed, it is preferred to configure similar to the present embodiment.

The lock member 500 according to the present embodiment has the two spring portions 540 which correspond to the lock sets, respectively. Moreover, each of the spring portions 540 supports the operated portion 560 and the lock portion 552 (hook 550) of the corresponding lock set. The operated portion 560 and the hook 550 may be supported by the respective two spring portions. However, the structure of the lock member 500 can be made simple by configuring similar to the present embodiment.

Referring to FIGS. 5 and 7, the fitted portion 130 according to the present embodiment is a recess formed in the housing 100 while the mating fitting portion 712 is a projection corresponding to the fitted portion 130. However, the fitted portion 130 may be a projection while the mating fitting portion 712 may be a recess, provided that the fitted portion 130 and the mating fitting portion 712 correspond to each other. In other words, the connector 10 may be not a receptacle but a plug.

The present application is based on a Japanese patent application of JP2014-043745 filed before the Japan Patent Office on Mar. 6, 2014, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector which is mateable with a mating connector along a front-rear direction, said mating connector comprising a mating fitting portion and a locked portion, wherein:

the connector comprises a fitted portion and a lock structure;

the fitted portion is fitted to the mating fitting portion under a mated state where the connector is mated with the mating connector;

the fitted portion and the lock structure are arranged in a first direction perpendicular to the front-rear direction;

the lock structure includes a lock member and an operation member;

the lock member has an operated portion and a lock portion;

the lock portion is movable in a first plane perpendicular to the first direction in conjunction with the operated portion;

the lock portion locks the locked portion under the mated state;

the operation member has an operation portion;

the operation portion is movable between a first position and a second position by a movement of the operation member; and under the mated state, when the operation portion is moved from the first position toward the second position, the operated portion is operated and moved by the operation portion, and the lock portion is moved in conjunction with the operated portion along a release direction, which is in parallel to the first plane, to unlock the locked portion.

2. The connector as recited in claim 1, wherein, when the operation portion is moved from the first position toward the second position under the mated state, the operated portion is operated by the operation portion and moved in a predetermined direction in parallel to the first plane.

3. The connector as recited in claim 2, wherein the predetermined direction is the release direction.

4. The connector as recited in claim 1, wherein, when the operation portion is moved from the first position toward the second position under the mated state, the operated portion is operated to be pressed and moved by the operation portion.

5. The connector as recited in claim 1, wherein:

the connector has two sets each of which is constituted of the operated portion, the lock portion and the operation portion; and the sets are located at opposite sides of the lock member in a direction perpendicular to the first direction, respectively.

6. The connector as recited in claim 5, wherein:

the lock member has two spring portions which correspond to the sets, respectively; and each of the spring portions supports the operated portion and the lock portion of the corresponding set.

7. The connector as recited in claim 1, wherein the operation portion is movable between the first position and the second position along a second direction which is the front-rear direction perpendicular to the first direction.

8. The connector as recited in claim 7, wherein:

the operation member has a protruding portion protruding in the first direction and a guide portion recessed in the first direction;

the guide portion extends along the second direction; and while the connector is mated with the mating connector, the locked portion is moved along the guide portion.

9. The connector as recited in claim 8, wherein:

the lock portion is located at a deep side of the guide portion;

and while the connector is mated with the mating connector, the locked portion is moved to the deep side of the guide portion along the guide portion.

10. The connector as recited in claim 7, wherein:

the connector comprises a shell which covers the fitted portion; and the shell has parts which protrude inward in a third direction to cover side portions of the operation member from outside in the first direction, wherein the third direction is perpendicular to both the first direction and the second direction, and the side portions are located at opposite sides of the operation member in the third direction.

11. The connector as recited in claim 7, wherein:

the lock member has a hook;

the lock portion is a part of the hook;

the hook is formed with a pressed portion;

the pressed portion intersects with the second direction; and while the connector is mated with the mating connector, the pressed portion is pressed by the locked portion in a direction in parallel to the first plane, and the hook is moved in the first plane to allow the locked portion to pass there through.

12. The connector as recited in claim 11, wherein:

the connector comprises a shell which covers the fitted portion; and the lock member is covered by the operation member and the shell to be invisible except the hook when seen along the first direction.

13. The connector as recited in claim 12, wherein the shell has parts which protrude inward in a third direction to cover side portions of the operation member from outside in the first direction, the third direction being perpendicular to both the first direction and the second direction, the side portions being located at opposite sides of the operation member in the third direction.

14. The connector as recited in claim 1, wherein:

the connector comprises a spring member and a first stopper;

the operation member has a first stopped portion;

the spring member applies a force to the operation member to urge the operation portion to be moved toward the first position; and the first stopper stops the first stopped portion to prevent the operation portion to be moved beyond the first position.

15. The connector as recited in claim 14, wherein the first stopper is a part of the lock member.

16. The connector as recited in claim 1, wherein:

the connector comprises a second stopper;

the operation member has a second stopped portion; and when the operation member is moved, the second stopper stops the second stopped portion to prevent the operation portion to be moved beyond the second position.

17. The connector as recited in claim 16, wherein:

the connector comprises a holding member;

the holding member holds the operation member while allowing the operation portion to be moved between the first position and the second position; and the second stopper is a part of the holding member.

* * * * *